US005547402A

United States Patent [19]

Ogawa

[11] Patent Number: 5,547,402

[45] Date of Patent: Aug. 20, 1996

[54] BULB SOCKET

[75] Inventor: Shinji Ogawa, Yokkaichi, Japan

[73] Assignee: Sumitomo Wiring Systems, Ltd., Yokkaichi, Japan

[21] Appl. No.: 265,800

[22] Filed: Jun. 27, 1994

[30] Foreign Application Priority Data

Jul. 14, 1993 [JP] Japan ..... 5-197863

[51] Int. Cl.[6] ..... H01R 17/00

[52] U.S. Cl. ..... 439/699.2; 439/356; 439/918

[58] Field of Search ..... 439/345, 350, 439/356, 611, 619, 699.1, 699.2, 918, 736; 313/318

[56] References Cited

U.S. PATENT DOCUMENTS 3,999,095 12/1976 Pearce, Jr. et al. ..... 439/699.2 X 5,120,233 6/1992 Mikola ..... 439/619 X

FOREIGN PATENT DOCUMENTS 2-47787 4/1990 Japan .

*Primary Examiner*—Khiem Nguyen
*Attorney, Agent, or Firm*—Oliff & Berridge

[57] ABSTRACT

A bulb socket for holding a wedge base bulb which has a bulb portion, a base portion and power terminals, the bulb socket comprising a socket body, supplying terminals and holder members. The socket body is provided for receiving the base portion of the wedge base bulb. The supplying terminals are electrically connecting with the respective power terminals of the wedge base bulb under a predetermined pressure, and are held by the socket body. The holder members are holding the base portion of the wedge base bulb therebetween under a predetermined pressure. And the holder members are separate from the supplying terminals, and are attached to the socket body.

20 Claims, 4 Drawing Sheets

BULB SOCKET

BACKGROUND OF THE INVENTION

This invention relates to a bulb socket for holding a wedge base bulb to supply electric power thereto.

One conventional socket for holding a wedge base bulb to supply electric power thereto is disclosed in Japanese Utility Model Unexamined Publication No. 2-47787. In this construction, a pair of metal members are attached to a socket body, and a supplying terminal portion and a resiliently-engageable portion, which are formed on each of these metal members, are exposed in a bulb insertion hole. When a base portion of the wedge base bulb is fitted in the bulb insertion hole, two power terminals mounted on the base portion are contacted respectively with the supplying terminals of the two metal members, so that electric power can be supplied to the wedge base bulb. At the same time, rugged portions formed on the base portion engage the resiliently-engageable portions of the two metal members, respectively, so that the base portion is held between the two resiliently-engageable portions to thereby prevent the wedge base bulb from withdrawal.

When attaching the wedge base bulb to the socket, it is desirable that a contact resistance at the area of contact between each supplying terminal and the associated power terminal be low, and it is also desirable that a resilient force at the area portion of contact between each resiliently-engageable portion and the associated rugged portion be large.

However, in the conventional construction, the supplying terminal portion, for supplying electric power to the wedge base bulb, and the resiliently-engageable portion, for holding the wedge base bulb, are formed as an integral metal member made of a single material. Therefore, the material of the metal member is required to perform both the functions of reducing the contact resistance and increasing the resilient force of the resiliently-engageable portion; however, there exists no material which achieve both functions effectively at low costs, and as a result both functions have not been entirely satisfactory.

In the meantime, a requirement for such a bulb socket, when used on a vehicle body, is that the amount of rearward projection of a light device should be reduced. Therefore, there is known a construction in which the other end of each metal member exposed in a bulb insertion hole is extended perpendicularly to the bulb insertion hole, so that the whole of the bulb socket assumes an L-shape.

In this case, the metal member is also of an L-shape, and hence can not be inserted into a casing through the bulb insertion hole after the casing is molded, and therefore there has been used a method (hereinafter referred to as "insert molding") in which a resin is molded on the periphery of the metal members while holding the metal members.

However, setting apart from the case where the metal member has a simple configuration, when the configuration is complicated as shown in the above-mentioned publication, such an insert molding is difficult because a gap may be formed between the metal member and a mold during the insert molding as a result of lowered dimensional accuracies, so that a resin flows into such a gap. In addition the metal members may interfere with the mold such that they cannot be sufficiently held by the mold. As a result, by an injection pressure, the metal members are deformed, and the resin is caused to flow. Furthermore, if the mold is complicated, it is difficult to feed the parts by a part feeder in an automated production.

It is an object of this invention to provide a construction in which functions of reducing a contact resistance at power supply portions for a wedge base bulb and securing a high holding force at those portions of engagement with the wedge base bulb are both achieved, and the manufacture can be carried out easily even if the configuration of the metal members is complicated.

SUMMARY OF THE INVENTION

In order to solve the above problems, the present invention provides a bulb socket for holding a wedge base bulb which has a bulb portion, a base portion and power terminals, the bulb socket comprising a socket body, supplying terminals and holder members. The socket body receives the base portion of the wedge base bulb. The supplying terminals electrically connect the respective power terminals of the wedge base bulb under a predetermined pressure, and are held by the socket body. The holder members hold the base portion of the wedge base bulb therebetween under a predetermined pressure. The holder members are separate from the supplying terminals and are attached to the socket body.

To solve another problem, the present invention further provides a bulb socket as described above in which the socket body is made of a resin, and the supplying terminals are integrally molded in the resin.

In the invention as set forth above, each of the supplying terminals for supplying electric power to the wedge base bulb is separate from the holder member for holding the wedge base bulb. Therefore, a material of the supplying terminal is selected to have such a nature as to achieve only the function to reduce a contact resistance at that portion of contact between the supplying terminal and the power terminal of the wedge base bulb. Also, a material of the holder member is selected to have such a nature as to achieve only the function to increase a resilient holding pressure at those portions of the holder member which hold the wedge base bulb. The holding force exerted by the holder member can be increased, for example, merely by increasing the sheet thickness thereof.

Furthermore, in the invention, the supplying terminals integrally molded in the resin are separate from the holder member, and is simple in shape. Therefore, the operation for forming such an integral construction can be carried out easily.

As described above, in the present invention, the material of the supplying terminals for supplying electric power to the wedge base bulb is different from the material of the holder members for holding the wedge base bulb. Therefore, the function of reducing the resistance of contact between the supplying terminal and the power terminal of the wedge base bulb, as well as the function of holding of the wedge base bulb by the holder members, can be both effectively achieved. Particularly, even if the same material is used, the bulb holding force can be increased merely by increasing the sheet thickness of the holder metal member. Of course, electrical connection is not needed for the holder member, and therefore in view of mechanical strength and the cost, stainless steel or the like can be selected as the material of the holder member.

The supplying terminal is separate from the holder member, and with this arrangement each of them is more simplified in shape as compared with the case where the two are formed integrally with each other. This enables the invention to be fabricated by insert molding, which is efficient, low-cost and can be carried out in an automated manner.

DETAILED DESCRIPTION OF THE PREFERRED EMBODIMENTS

One preferred embodiment of the present invention will now be described with reference to the drawings.

Figure 1:
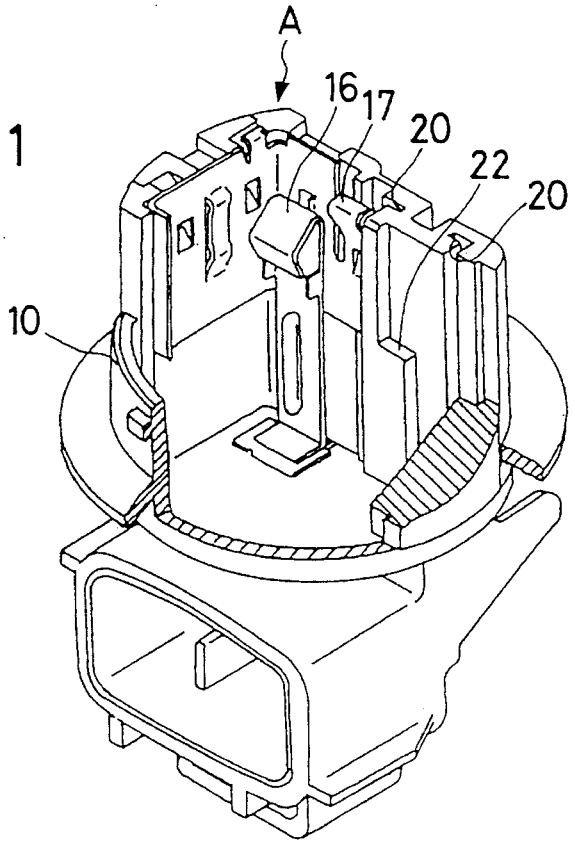
FIG. 1 is a partly-broken, perspective view of a socket body.
Figure 10:
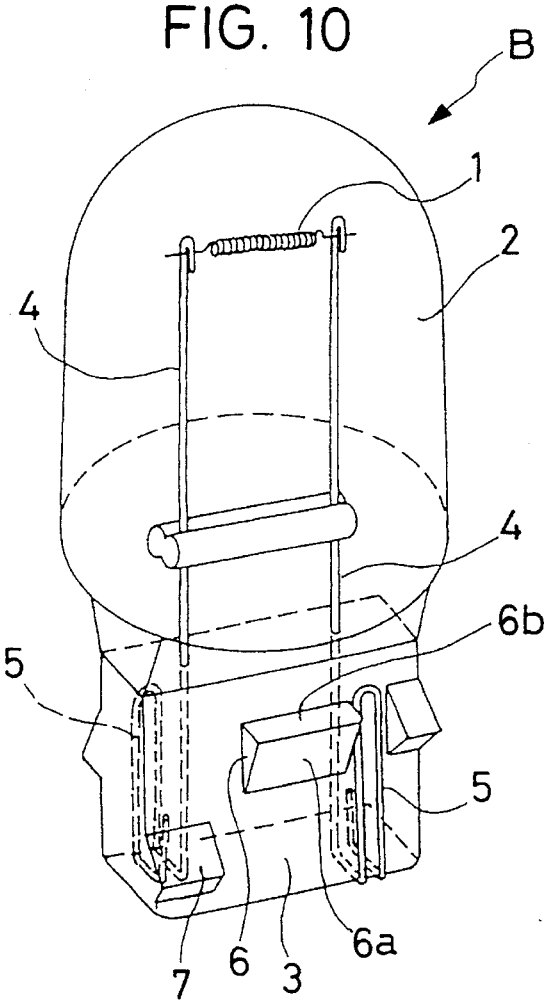
FIG. 10 is a perspective view of a wedge base bulb.

A bulb socket A shown in FIG. 1 is adapted to hold a wedge base bulb B of the single filament type shown in FIG. 10. In the wedge base bulb B, a flattened base portion 3 is integrally molded on a lower portion of a bulb portion 2 which contains a filament 1 therein. Two lead wires 4 extending from a lower surface of the base portion 3 are folded respectively on opposite (right and left) sides of the base portion 3 to form power terminals 5. An upwardly-slanting projection 6 and an abutment projection 7 are formed on each of the opposite right and left sides of the base portion 3.

Figure 2:
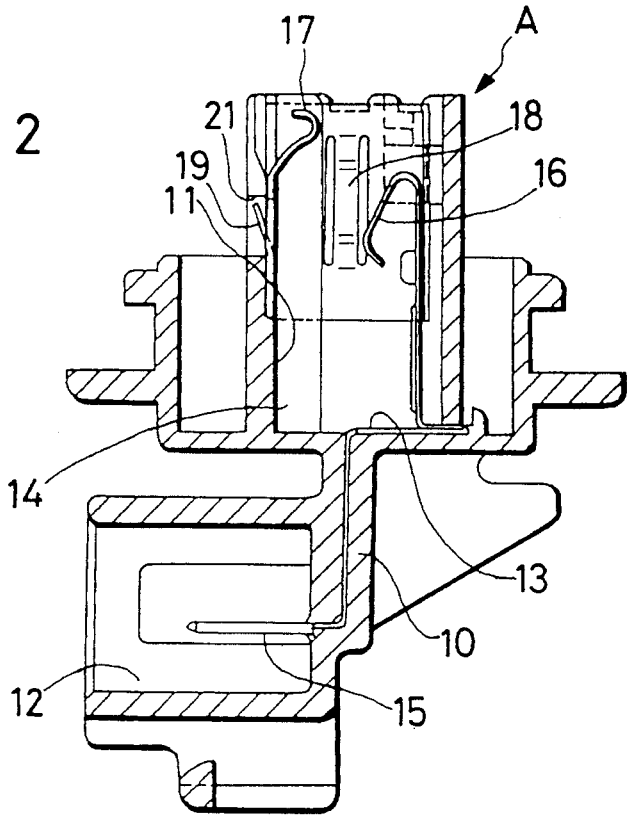
FIG. 2 is a cross-sectional view of the socket body as viewed in a direction perpendicular to a connector insertion hole in the socket body.
Figure 3:
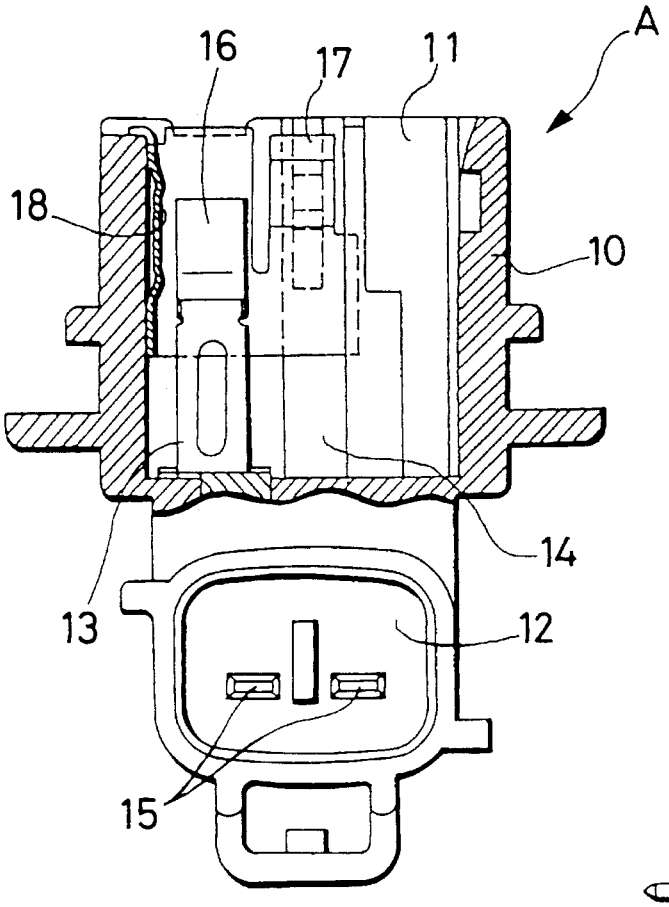
FIG. 3 is a partly cross-sectional, side-elevational view of the socket body as viewed from the connector insertion hole side.
Figure 4:
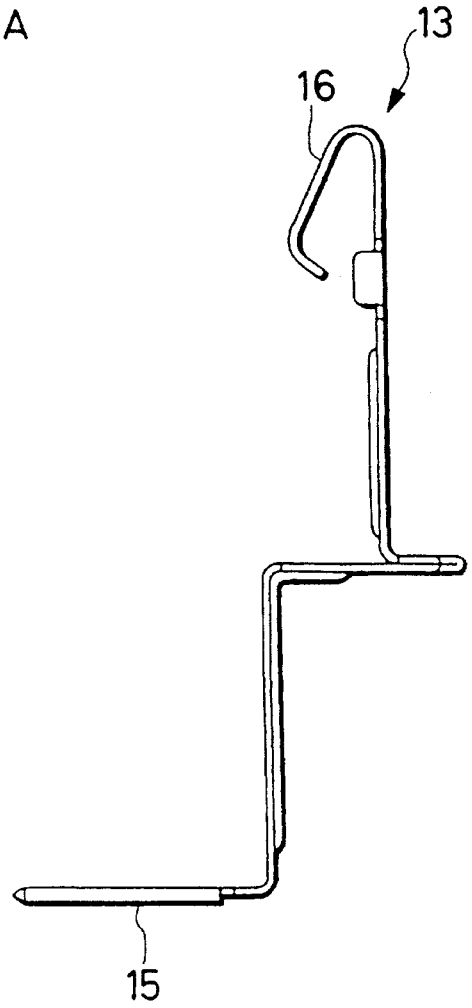
FIG. 4 is a right side-elevational view of a supplying terminal.
Figure 5:
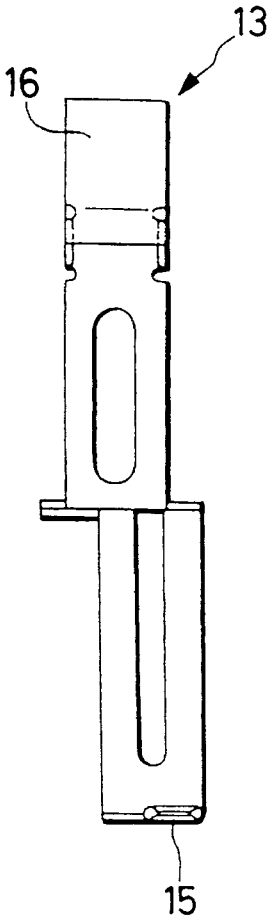
FIG. 5 is a front-elevational view of the supplying terminal.
Figure 6:
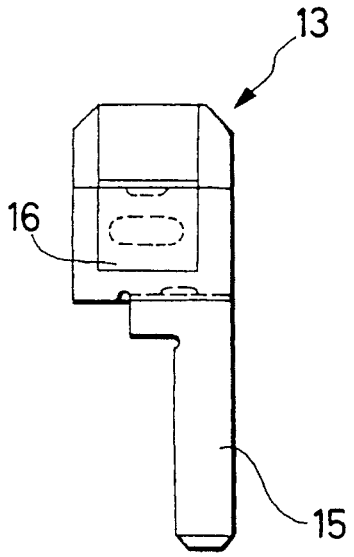
FIG. 6 is a plan view of the supplying terminal.
Figure 7:
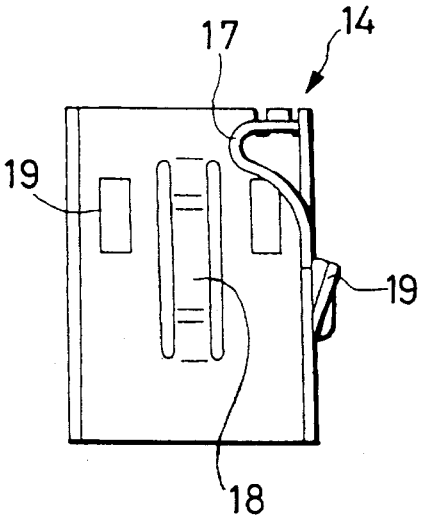
FIG. 7 is a right side-elevational view of a holder metal member.
Figure 8:
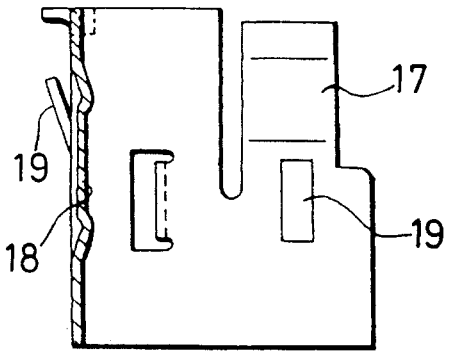
FIG. 8 is a cross-sectional view of the holder metal member.
Figure 9:
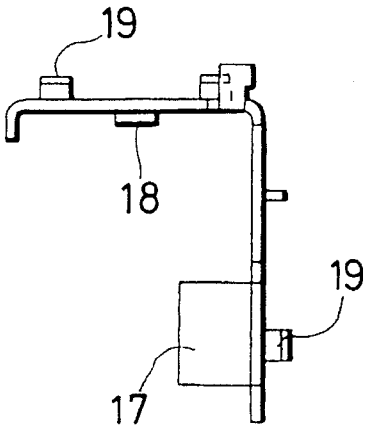
FIG. 9 is a plan view of the holder metal member.

A socket body 10 of the bulb socket A is made of a synthetic resin material. The socket body 10 has a bulb insertion hole 11 for receiving the base portion 3 of the wedge base bulb B, and a connector insertion hole 12 for connecting a power supply connector (not shown) thereto. The bulb insertion hole 11 and the connector insertion hole 12 are open perpendicularly to each other, and the socket body 10 assuming an L-shape as a whole, as shown in FIG. 2. Two supplying terminals 13 (shown in FIGS. 4 to 6) for supplying electric power to the wedge base bulb B, as well as two holder metal members 14 (shown in FIGS. 7 to 9) for holding the wedge base bulb B against withdrawal, are mounted on the socket body 10.

The supplying terminal 13 is formed by bending an elongate strip of an electrically-conductive metal material which can keep a resistance of contact with the power terminal 5 of the wedge base bulb 5 to a low level. The supplying terminal 13 has one end portion defining a connector connecting portion 15 in the form of a flat strip, and a bulb connecting portion 16 formed by folding a tip portion of the other end portion extending in a direction perpendicular to the connector connecting portion 15.

The two supplying terminals 13 are connected integrally with the socket body 10 by insert molding during the molding of the socket body 10 in such a manner that these supplying terminals are held against withdrawal and movement. In this connected condition of these supplying terminals 13, the connector connecting portions 15 of the two supplying terminals 13 are projected into the connector insertion hole 12 in juxtaposed relation to each other. The two bulb connecting portions 16 are disposed respectively on opposed right and left sides of the inner surface of the bulb insertion hole 11.

The holder metal member 14 is formed by bending a sheet of metal having a high elastic coefficient into an L-shape which metal sheet is larger in thickness than the supplying terminal 13. And a curved resilient engagement portion 17 is formed on and projected inwardly from one of two perpendicularly-disposed plate portions of the holder member 14 while a part of the other plate portion is stamped and slightly bulged inwardly to form a play restraining portion 18. Also, a part of each of the two plate portions is stamped and raised obliquely upwardly to form a withdrawal prevention portion 19.

The two holder metal members 14 are forced into the bulb insertion hole 11 to be attached thereto in such a manner that the outer surfaces of their plate portions are held in intimate contact with the inner surface of the bulb insertion hole. In this attached condition, the resilient engagement portions 17 are disposed respectively on the right and left sides of the inner surface of the bulb insertion hole 11, and the play restraining portions 18 for the bulb are disposed respectively on the front and rear sides of the inner surface of the bulb insertion hole. Also, in the attached condition, the opposite side edges of the holder metal member 14 are fitted respectively in positioning grooves 20 in the bulb insertion hole 11, and the withdrawal prevention portions 19 are engaged respectively with notches 21 in the bulb insertion hole 11, thereby preventing the holder metal member 14 from shaking and moving in a withdrawing direction.

For attaching the wedge base bulb B to the bulb socket A provided with the supplying terminals 13 and the holder metal terminals 14, the base portion 3 of the wedge base bulb B need only to be pushed into the bulb insertion hole 11 of the bulb socket A. At this time, a slanting surface **6*a* of each of the upwardly slanting projections 6 of the base portion 3 abuts against the resilient engagement portion 17 of the corresponding holder metal member 14, and resiliently deforms the same gradually, and simultaneously when the abutment projection 7 abuts against an abutment portion 22 formed on the inner surface of the bulb insertion hole 11, the resilient engagement portion 17 is disengaged from the slanting surface 6*a* of the upwardly slanting projection 6 to be resiliently restored. As a result, the two resilient engagement portions resiliently hold the base portion 3 from the opposite sides thereof, and also are engaged respectively with upwardly-directed engagement surfaces 6*b* of the upwardly slanting projections 6. Also, the base portion 3 is resiliently held between the play restraining portions 18 of the holder metal members 14 in such a manner that the play restraining portions 18 are strongly pressed respectively against the front and rear sides of the base portion 3. As a result, the base portion 3 of the wedge base bulb B is held against withdrawal from the bulb insertion hole 11 and also against shaking. During the insertion of the base portion 3 into the bulb insertion hole 11, the bulb connecting portions 16 of the supplying terminals 13 are pressed to be slightly resiliently deformed, so that these portions 16 are contacted respectively with the power terminals 5 on the base portion 3 under a predetermined pressure, thus enabling the supply of electric power. The connector (not shown) is inserted in the connector insertion hole 12, and the connector connecting portions 15 of the supplying terminals 13** are fitted in and contacted with terminals of this connector, respectively, thus enabling the supply of electric power.

On the other hand, the holder metal member 14 has a high elastic coefficient, and therefore a high holding force is provided at those portions of contact between the holder metal member 14 and the wedge base bulb B.

Only the supplying terminals 13 are insert molded in the socket body 10, and the holder metal members 14 are not insert molded. Therefore, as compared with the case where the supplying terminals 13 and the holder metal members 14 are both inserted molded, the insert operation can be carried out more easily because of a simple shape of the insert members and also of the ease of holding the insert members in a mold.

And besides, since the supplying terminal 13 is separate from the holder metal member 14, each of them is simpler in shape as compared with the case where the two are formed into an integral construction, and therefore an improved efficiency of the operation, as well as the reduction of the manufacturing cost, can be achieved by carrying out the insert molding in an automated manner.

The present invention is not to be limited to the above embodiment, and for example, the following modifications can be made:

(a) Although the above embodiment has been described with respect to the bulb socket for holding the wedge base bulb of the single filament type, the present invention can also be applied to a bulb socket for holding a wedge base bulb of the double filament type.

(b) Although the above embodiment has been described with respect to the bulb socket of a generally L-shape in which the bulb insertion hole 11 and the connector insertion hole 12 are open perpendicularly to each other, the present invention can be applied to a bulb socket of such a configuration that a bulb insertion hole and a connector insertion hole are open in opposite directions, respectively. In this case, supplying terminals may be attached by inserting these supplying terminals into one of the two insertion holes in a molded socket body, or the supplying terminals may be made integral with the socket body by insertion molding as in the above embodiment.

The present invention is not limited by the embodiment described above and illustrated in the drawings, and various modifications can be made without departing from the subject matter of the invention.

What is claimed is:

1. A bulb socket for holding a wedge base bulb which has a bulb portion, a base portion and power terminals, said bulb socket comprising:

a socket body for receiving the base portion of the wedge base bulb, said socket body having a longitudinal axis;

supplying terminals for electrically connecting with the respective power terminals of the wedge base bulb under a predetermined pressure, said terminals being held by said socket body; and holding means for holding the base portion of the wedge base bulb therebetween under a predetermined pressure, said holding means having a plate-like portion extending substantially parallel to said longitudinal axis and being electrically non-conducting, separate from said supplying terminals and attached to said socket body.

2. A bulb socket according to claim 1, wherein said socket body is made of a resin, and said supplying terminals are integrally molded in said resin.

3. A bulb socket according to claim 1, wherein said holding means is made of metal.

4. A bulb socket according to claim 3, wherein said socket body is made of a resin, and said supplying terminals are integrally molded in said resin.

5. A bulb socket according to claim 1, wherein said holding means comprises:

a first engagement portion for engaging said holding means with said socket body;

a second engagement portion for engaging said holding means with the base portion of the wedge base bulb; and a play restraining portion for restraining a play between said holding means and the base portion of the wedge base bulb.

6. A bulb socket according to claim 5, wherein said first engagement portion includes a side surface of said holding means shaped to slidingly engage a positioning groove in said bulb socket.

7. A bulb socket according to claim 5, wherein said second engagement portion includes a curved resilient portion that projects inwardly to engage the base portion of the wedge base bulb.

8. A bulb socket according to claim 5, wherein said play restraining portion includes a projection that protrudes between said holding means and the base portion of the wedge base bulb.

9. A bulb socket according to claim 1, wherein said holding means includes withdrawal prevention portions projecting between said holding means and said bulb socket to prevent movement of said holding means in the axial direction relative to said bulb socket.

10. A bulb socket according to claim 1, wherein said holding means is disposed adjacent and within an inner surface of an outer periphery of said bulb socket.

11. A bulb socket that holds a wedge base bulb having a bulb portion, a base portion and power terminals, said bulb socket comprising:

a socket body having a longitudinal axis and being shaped to receive the base portion of the wedge base bulb;

supplying terminals that electrically connect to the respective power terminals of the wedge base bulb under a predetermined pressure, said supplying terminals being attached to said socket body; and an electrically non-conducting holding element that holds the base portion of the wedge base bulb substantially parallel to the longitudinal axis under a predetermined pressure, said holding element having a plate-like portion and being separate from said supplying terminals and attached to said socket body.

12. A bulb socket according to claim 11, wherein said socket body is made of a resin and said supplying terminals are integrally molded in said resin.

13. A bulb socket according to claim 11, wherein said holding element is made of metal.

14. A bulb socket according to claim 13, wherein said socket body is made of a resin and said supplying terminals are integrally molded in said resin.

15. A bulb socket according to claim 11, wherein said holding element includes a first engagement portion that engages said holding element with said socket body, a second engagement portion that engages said holding element with the base portion of the wedge base bulb and a play restraining portion that restrains play between said holding element and the base portion of the wedge base bulb.

16. A bulb socket according to claim 15, wherein said first engagement portion includes a side surface of said holding element shaped to slidingly engage a positioning groove in said bulb socket.

17. A bulb socket according to claim 15, wherein said second engagement portion includes a curved resilient portion that projects inwardly to engage the base portion of the wedge base bulb.

18. A bulb socket according to claim 15, wherein said play restraining portion includes a projection protruding between said holding element and the base portion of the wedge base bulb.

19. A bulb socket according to claim 11, wherein the holding element includes withdrawal prevention portions projecting between said holding element and the bulb socket to prevent movement of said holding element in the axial direction relative to said bulb socket.

20. A bulb socket according to claim 11, wherein the holding element is disposed adjacent and within an inner surface of an outer periphery of the bulb socket.

* * * * *